United States Patent [19]

Eckenrodt

[11] Patent Number: 4,575,985

[45] Date of Patent: Mar. 18, 1986

[54] REBAR SADDLE

[76] Inventor: Richard H. Eckenrodt, 9660 N. Ridge View Pl., Oro Valley, Ariz. 85704

[21] Appl. No.: 747,917

[22] Filed: Jun. 24, 1985

[51] Int. Cl.[4] ..... E04C 5/16

[52] U.S. Cl. ..... 52/677; 52/686

[58] Field of Search ..... 52/684, 685, 686, 677, 52/699, 370, 244, 300

[56] References Cited

U.S. PATENT DOCUMENTS

| | | | |
|---|---|---|---|
| 1,672,852 | 6/1928 | Roughan | 52/677 |
| 1,727,478 | 9/1929 | Mathews . | |
| 1,850,868 | 3/1932 | Drake . | |
| 2,194,834 | 3/1940 | Nealon . | |
| 2,634,603 | 4/1953 | Byars et al. . | |
| 2,867,041 | 1/1959 | McMillan | 52/677 X |
| 3,105,423 | 10/1963 | Reiland . | |
| 3,114,221 | 12/1963 | Eriksson . | |
| 3,255,565 | 6/1966 | Menzel | 52/684 X |
| 3,451,179 | 6/1969 | Kendzia | 52/370 |
| 3,623,289 | 11/1971 | Lowery | 52/685 X |
| 3,693,310 | 9/1972 | Middleton | 52/685 |
| 3,921,356 | 11/1975 | Hughes | 52/370 X |
| 4,283,899 | 8/1981 | Wakamiya | 52/699 |

*Primary Examiner*—Carl D. Friedman

*Attorney, Agent, or Firm*—J. Michael McClanahan

[57] ABSTRACT

A rebar saddle for receiving reinforcing bars used in strengthening concrete consisting of an elongated cylinder having at one end a saddle to receive and secure the reinforcing bar and at the other end a blind hole to receive the top of a stake or bar driven into the ground which suspends the reinforcing bar saddle and thus the held reinforcing bar, in position to have concrete poured around it. By the utilization of a plastic or non-rusting rebar saddle, rust which might enter the concrete structure by way of a metal stake which penetrates the ground is halted by the rebar saddle.

17 Claims, 6 Drawing Figures

REBAR SADDLE

BACKGROUND OF THE INVENTION

Problems have recently arisen in the art of forming reinforced concrete structures, and in particular, concrete structures in which the reinforcing steel has a connection with surrounding earth, usually typlified by the footings or foundations utilized in homes or other concrete structures. The long time practice for locating the footing is to dig a trench in the ground and, to impart tensile strength to the concrete which will fill the trench and constitute the footing, to lay one or more horizontal layers of steel reinforcing bars. To impart the necessary tensile strength to the footing, these reinforcing bars, termed "rebars", are usually laid at a height above the ground which is generally $\frac{1}{3}$ to $\frac{1}{2}$ the total resultant height of the concrete footing. For example, if a concrete footing is to be 12 inches in depth, the rebar would lie at a distance of approximately 4 to 5 inches from the bottom surface of the concrete, and thus 4 to 5 inches above the bottom of the dug trench. The common practice is to drive a vertical stake into the ground at the bottom of the trench, and then attach at the proper height the horizontal rebar with a piece of wire wrapped crossways around both the stake and the horizontal rebar. In addition, it has been most convenient to use a short piece of rebar as the vertical stake since it may be pounded easily into the ground, and provides the necessary strength to hold the horizontal rebar in place against the force of the concrete as it is poured around the horizontal rebar and the vertical stake.

The problems which have developed and which are now coming to light is that the vertical stake, when rustable metal, tends to start rusting in the ground and the rust creeps on up into the set concrete where it meets the horizontal rebar. It will then commence rusting the horizontal rebar at the junction of where the stake meets the horizontal rebar and then will proceed in both directions, rusting the horizontal rebar until the rebar has totally rusted out in the footing.

Although there have been rebar saddles developed which uplift the horizontal rebar off the bottom of the trench, the common practice now utilized is to suspend the horizontal rebar from above, namely by placing a 2×4 piece of wood spanning the trench with wire suspended from it to hold the horizontal rebar. Then the concrete is poured around the above suspended rebar. However, the problem with this method is that the rebar is not held stationary in place against horizontal movement when the concrete is poured into the trench and as a result, the rebar in many cases will move during pouring and not end up solidifying in the concrete where it was intended to be placed. This is because the concrete, unless it is poured exactly on top of the rebar, will push the rebar in one direction or another and the rebar does not return to its originally suspended position before the concrete hardens.

As mentioned above, rebar saddles have been developed which hold the rebar above the bottom of the trench, however, they have not met the problem of traveling rust, as many of the prior art rebar saddles are made from metal which will rust and, they suffer from the shortcoming that they cannot begin to approach the cost of using a short piece of rebar as the vertical stake.

As a consequence, there exists a need where the economy of utilizing a vertical stake made from rebar or other economic material which may rust may be combined with a rebar saddle to secure horizontally placed rebar, while yet presenting a barrier to traveling rust which tends to destroy the integrity of the reinforcing horizontal bars in the concrete.

SUMMARY OF THE INVENTION

This invention relates to a rebar saddle for holding and securing against movement the horizontal reinforcing bars which are to be set into concrete and which are placed in forms to receive the concrete when preparing a concrete structure. To this end, the invention comprises a rebar saddle adapted to reside upon a stake which is driven into the ground to receive and secure the rebar saddle in place against lateral or downward movement by means of a blind hole in the rebar saddle which encompasses the top of the stake. Additionally formed in the top portion opposite the blind hole of the rebar saddle is a horseshoe shaped saddle adapted to receive the horizontal reinforcing bar.

Construction of the rebar saddle is accomplished by firstly forming in a solid cylinder having a cross-section which may be variously circular, square, rectangle, or multi-sided, at one end of the cylinder a blind hole of sufficient diameter and depth to reside over the top of a stake, rod, or pole driven vertically into the ground.

At the other end of the cylinder is formed one or more horseshoe shaped saddles to receive and secure the horizontally placed reinforcing bar. Thus the horizontal reinforcing bar is held against lateral and downward movement, and its weight holds it in the saddle of the rebar saddle in order that concrete, being poured around the horizontal rebar, will not dislodge it from its selected position. In addition, the saddle, having a top opening less wide than its center part, tends to clamp the rebar in place against upward movement.

An alternate embodiment varies the shape of the saddle adapted to receive the horizontal rebar, to a "U" shape, and in another embodiment, the subject invention may be used as a spacer, either above a horizontal ground plane, or to space rebar at a set distance from a vertical wall such that rebar may be located horizontally or vertically at distances from the ground or horizontal floor.

By utilizing a plastic or other rust resistent material in the rebar saddle, rust traveling into the concrete structure through an iron or rusting metal stake may be stopped before the rust can attack the horizontal rebar.

It is an object of the subject invention to provide a rebar saddle to secure horizontal rebar and inhibit the travel of rust through a stake into the ground from reaching the horizontal rebar.

It is another object of the subject invention to provide a rebar saddle which resides on a stake driven into the ground and adapted to receive and secure horizontal rebar.

It is still further an object of the subject invention to provide a rebar saddle for spacing and securing rebar away from a horizontal or vertical surface in order that concrete may be poured in and around the horizontal or vertical rebar.

Other objects of the invention will in part be obvious and will in part appear hereinafter. The invention accordingly comprises the apparatus possessing the construction, combination of elements, and arrangement of parts which are exemplified in the following detailed disclosure, and the scope of the Application which will be indicated in the claims.

BRIEF DESCRIPTION OF THE DRAWINGS

For further understanding of the nature and objects of the present invention, reference should be had to the following detailed description taken in connection with the accompany drawings wherein.

In the various views, like index numbers refer to like elements.

DETAILED DESCRIPTION OF THE PREFERRED EMBODIMENT

Figure 1:
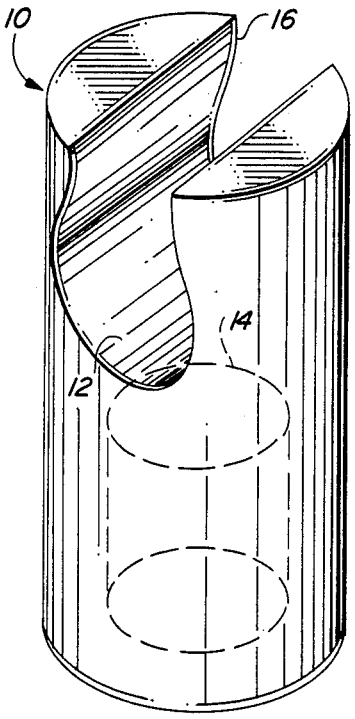
FIG. 1 is a perspective view of the preferred embodiment of the invention.

Referring now to FIG. 1, a perspective view of the preferred embcdiment of the inventive rebar saddle is shown. In the preferred embodiment, the invention comprises, in the main, a solid cylinder made of plastic, non-rusting metal, or non-corroding or rusting material, one end of which has horseshoe shaped saddle 12 formed transversely to the longitudinal axis of the cylindrical piece, and at the other end a blind hole 14 with its axis parallel to the cylindrical longitudinal axis.

The saddle 12 is formed in the shape of a horseshoe with the opening slightly smaller than the interior diameter trough. The saddle 12 is adapted to receive and hold reinforcing bar used in concrete construction to impart tensile strength to the formed concrete. The reinforcing bar, termed "rebar", is pushed down into saddle 12 past the upper enclosing rounded lip 16 which presents a barrier to easy removal. Obviously, horseshoe saddle 12 must be constructed of a material which has some degree of flexibility, such as plastic. It is anticipated that the interior diameter trough of saddle 12 should be slightly larger than the largest diameter of the rebar and that the opening diameter be slightly less than the rebar. It is normal for the rebar to have outstanding ridges located on its circular surface and the cross diameter of the saddle 12 should be great enough to accomodate the diameter of the rebar at the point of the rebar ridges.

Blind hole 14 is adapted to receive the end of a stake or other means driven into the ground adapted to support the rebar in position prior to and while the concrete is being poured around it. Again, obviously, the diameter of blind hole 14 should be slightly larger than the stake utilized. If possible, a snug fit is preferred. In common usage, a workman will cut short pieces of steel rebar, normally in the range of 8 to 14 inches and then use this stake to receive the rebar saddle as a standard to support the horizontal rebar which reinforces the concrete structure.

Utilizing the subject invention, a stake made from rebar material, or any other material, is driven into the ground to a level where the top of the stake is approximately $\frac{1}{4}$ to $\frac{1}{2}$ inch below the point at which it is desired the reinforcing bar to reside prior to and during pouring of the concrete. Rebar saddle 10 is slipped over the protruding end of the stake until the bottom of blind hole 14 engages the top of the stake. That locates the saddle 12 to receive the rebar. A plurality of stakes and rebar saddles are located at sufficient distance along the proposed path of the rebar to suspend the rebar above the floor or the surface which is to receive the concrete. It is envisioned that if a house foundation were being constructed, and if two parallel rebars were to be placed throughout the total length of the foundation, stakes would be driven into the ground every 4 to 6 feet to a point where the bottom of rebar saddle upper opening 12 was at a point of approximately $\frac{1}{3}$ to $\frac{1}{2}$ the depth the concrete is to be placed. For example, if a 12 inch footing or foundation were to be poured, a stake would be driven into the ground to the point where its top was approximately 4 inches above the ground. The blind hole 14 of rebar saddle 10 would be placed over the stake and if the distance between the bottom of blind hole 14 and the bottom of saddle 12 were $\frac{1}{2}$ inch, rebar laying in saddle 12 would be located at a height of approximately $4\frac{1}{2}$ inches into the 12 inch footing which would be satisfactory for most home footings. If a pair of parallel rebars were used in the concrete footinq, the above procedure would have to be duplicated for the second rebar.

After the stake is located in the ground, the rebar saddle 10 placed upon the stake, the rebar located in the saddle 12 of the rebar saddle 10, and the concrete poured around the combination. It is expected that all parts will remain in position in the concrete and will not be removed.

Figure 2:
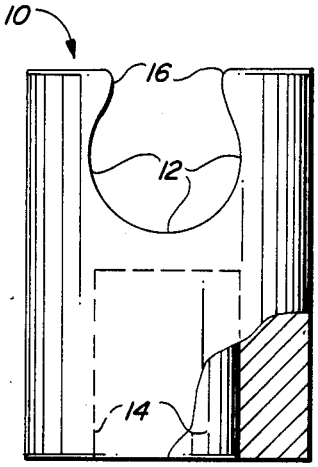
FIG. 2 is a side view of the preferred embodiment of the subject invention.

Referring now to FIG. 2, a side view of the preferred embodiment of rebar saddle 10 is shown. Here disclosed is a side view of saddle 12 adapted to receive the rebar and the upper rounded lip 16 past which the rebar must be pushed to enter the primary cavity of saddle 12. Lip 16 is slightly rounded to allow the rebar to pass by it with as little resistance as possible. In the lower portion of rebar saddle 10 is blind hole 14 shown in dotted format. As earlier indicated, in the preferred embodiment, the distance between the bottom of blind hole 14 and the bottom of saddle 12 should be in the order of $\frac{1}{4}$ to $\frac{1}{2}$ inch. In addition, for best results, it is suggested that the bottom of blind hole 14 not be a plug in a piece of pipe where moisture could pass around the plug and permit rust to attack the rebar laying in saddle 12, but in the preferred embodiment, rebar saddle 10 is formed from a solid cylindrical piece.

Figure 3:
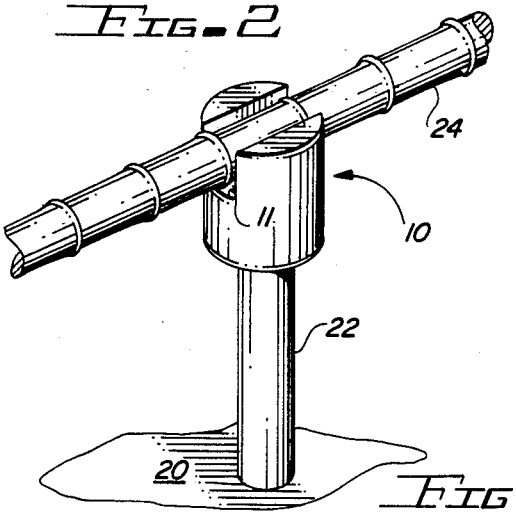
FIG. 3 is a perspective view of the invention in use suspending and securing horizontal reinforcing bar.

Referring now to FIG. 3, a perspective view of the invention with an alternate "U" shaped saddle is shown in place in actual use suspending rebar above the ground ready to receive the concrete mixture. Firstly, rebar saddle 10 is located upon stake 22 which may be of a metal, such as iron rebar, or it may comprise wood or any other material capable of being driven into the ground 20. Rebar saddle 10 is held in place upon stake 22 by stake 22 slipping into blind hole 14 (not shown). By such positioning, rebar saddle 10 is prevented from movement in the horizontal plane and downward, and the only movement then possible to rebar saddle 10 would be vertically up. However, by installation of rebar 24 into the saddle 11 of rebar saddle 10, the weight of rebar 24 (and if a horseshoe saddle 12 is utilized, the upper portion is narrowed) tends to keep rebar saddle 10 situated in place. It is noted that in the embodiment shown in FIG. 3 the saddle 11 of rebar saddle 10 has been modified in that the sides of saddle 12 are vertical, and that the lip formed at the top of rebar saddle 10 is not present. As indicated before, the invention as shown in FIGS. 1–3 is located along rebar 24 at appropriate distances sufficient to hold rebar 24 in place at an appropriate distance above the ground without excess sagging.

Figure 4:
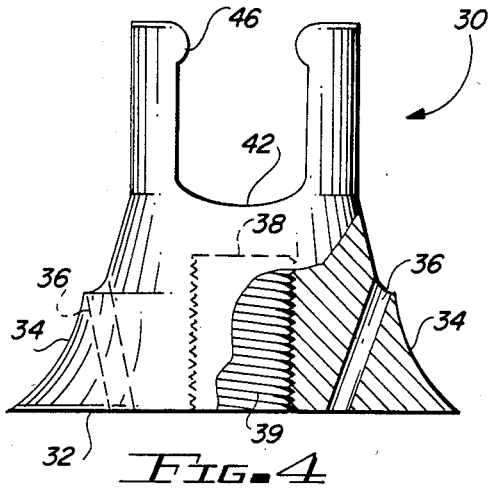
FIG. 4 is a side view of an alternate embodiment of the invention used as a vertical or horizontal spacer.

Referring now to FIG. 4, another embodiment of the invention is shown in side view where rebar saddle 30 has an enlarged base formed by flaring out sides 34 to form a flared skirt. In addition, at least two nail holes 36 are shown communicating between the flared sides 34 and the base 32. Like the preferred embodiments, blind hole 38 is centrally located in base 32 and saddle 42 opening up to the top of rebar saddle 30 is shown. Blind hole 38 may also be fitted with threads 39 shown in dotted format. Rounded lip 46 then is located at the very entrance of "U" shaped saddle 42 with the top surface of rebar saddle 30.

With the embodiment of the device shown in FIG. 4, the invention may be adapted as a spacer, fixing the distance of the rebar from the sides, the bottom, or the top of forms into which concrete will be poured. In addition, the alternate embodiment of FIG. 4 can rest upon the ground in a situation similarly as described in FIG. 3 where the base 32 engages the ground and the distance from the base 32 to the bottom of saddle 42 is the required distance that the rebar is to be lifted up off the ground. It is noted that use of the rebar saddle 30 does not necessarily obviate the need for the central stake or pin over which blind hole 38 is to be encompassed if nails are not used and resistance to horizontal movement is to be imparted. When rebar saddle 30 is used on a horizontal earth ground situation, the stake which is to be received by blind hole 38 may be necessary to locate the rebar saddle. If rebar saddle 30 is to be placed on a lower horizontal level, and wood is used in the form to receive the concrete rather than the usual ground, then the pin or stake which is encompassed by blind hole 38 is optional, but may be used to fix the location of rebar saddle 30, and the saddle held down with nails through nail holes 36.

Figure 5:
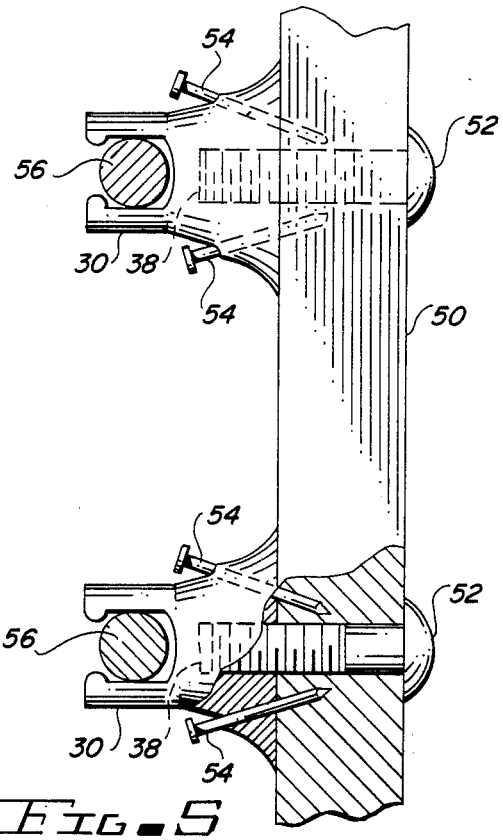
FIG. 5 is a side view of the alternate embodiment of the invention used to space horizontal rebar from a vertical wall form.

If rebar saddle 30 of FIG. 4 is to be used as a spacer for rebar from a vertical wall, it may be located and held in place such as shown in FIG. 5. Referring now to FIG. 5, form 50, made from wood or metal, is shown in a vertical position adapted to present a vertical form to the concrete which is to be poured against the side of the form containing rebar saddle 30. Penetrating form 50 are bolts 52 which penetrate into the blind hole 38 of rebar saddle 30 and locate the position of rebar saddle 30. While the bolts 52 will secure rebar saddle 30 in a position relative to the plane of form 50, there may be a tendency for the rebar saddle to fall from its position over bolt 52 and therefore nails 54 are inserted through the nail holes 36 as shown in FIG. 3 and into form 50, if wood. The nails 54, when driven completely in, secure rebar saddle 30 to form 50, holding it securely in place against all movement. Not to be overlooked, it is realized that threads 39 may be formed in blind hole 38 which will mate with the threads on bolt 52 and hold rebar saddle 30 in place over threaded bolt 52 without the need for nails.

Shown residing within saddle 42 of rebar saddle 30 are rebar 56, secured by the lip 46 of the saddle.

Figure 6:
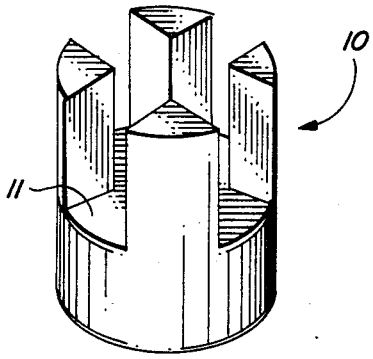
FIG. 6 a perspective view of another alternate embodiment of the invention.

FIG. 6 is a perspective view of still another alternate embodiment of rebar saddle 10 wherein mutually perpendicular "U" shaped saddles 11 have been formed in the upper portion of the cylinder to receive crossing rebars.

In the drawings shown, and in particular FIGS. 1 and 4, the rebar saddles have been shown as circular solid cylinders. Additionally, it is anticipated that the rebar saddle 30 shown in FIG. 3 is in addition a cylindrically shaped device. However, the construction of the rebar saddles 10 and 30 need not be circular cylinders, but in fact may be square in cross-section or, for that matter rectangular, or in even some circumstances triangular. The saddles 12 and 42, and the blind holes 14 and 38 are not dependent upon the exterior peripheral surface of the device, and therefore a great number of outer surfaces may be utilized. For example, the rebar saddle 30 shown in FIGS. 3 and 5 can have a square top and a square base without departing from the spirit and scope of the invention.

Further, it is also apparent that two saddles at right angles to each other may be formed in the rear saddles shown in order to permit the rebar to cross at the location of the rebar saddle.

While the discussion has centered upon a plastic non-rusting metal or other non-corroding material for use as the rebar saddle 10, it is realized of course that even a rusting metal rebar saddle 10 may be utilized if the stake which supports the rebar saddle is made of a non-rusting material such as plastic, which does not transmit moisture.

While a preferred embodiment of Applicant's invention has been shown and described, together with alternate embodiments thereof, it is appreciated that still other embodiments of the invention are possible and that there is no intent to limit the invention by such disclosure, but rather it is intended to cover all modifications and alternate embodiments falling within the spirit and the scope of the invention as defined by the appended claims.

I claim:

1. A rebar saddle for securing and suspending above ground reinforcing bars used in strengthening concrete comprising:

an elongated solid cylinder having a first and second end, sides, and longitudinal axis;

said elongated solid cylinder first end defining a saddle formed therein adapted to receive and secure the reinforcing bar; and said elongated solid cylinder second end defining a blind hole formed therein adapted to receive a stake driven into the ground whereby the rebar saddle suspends the reinforcing bar in position to have concrete poured around it and cured.

2. The rebar saddle as defined in claim 1 wherein said saddle includes a horseshoe shaped opening with a trough situated transversely to the longitudinal axis of said cylinder.

3. The rebar saddle as defined in claim 2 wherein said horseshoe shaped opening defines an opening having upper enclosing lips separated by a distance less than the diameter of the horseshoe trough.

4. The rebar saddle as defined in claim 3 wherein said blind hole formed in said cylinder includes a hole having its longitudinal axis parallel to longitudinal axis of the cylinder.

5. The rebar saddle as defined in claim 1 wherein said saddle adapted to receive reinforcing bar defines a "U" shaped opening with a trough situated transversely the longitudinal axis of the cylinder.

6. The rebar saddle as defined in claim 1 further including a flared skirt proximate the blind hole, said flared skirt formed by enlarging the cylinder sides proximate its second end.

7. The rebar saddle as defined in claim 6 further including a pair of nail openings penetrating the cylinder sides to the second end, the nail openings adapted to receive nails to nail the rebar saddle to an associated object.

8. The rebar saddle as defined in claim 1 wherein said blind hole includes threads formed therein, said threads adapted to receive an associated threaded bolt in order to secure said rebar saddle thereon.

9. The rebar saddle as defined in claim 1 wherein said elongated solid cylinder first end additionally defines a second saddle formed therein, said second saddle also adapted to receive and secure the reinforcing bar.

10. The rebar saddle as defined in claim 1 wherein said solid cylinder comprises non-rusting material.

11. The rebar saddle as defined in claim 10 wherein said solid cylinder comprises plastic material.

12. The rebar saddle as defined in claim 11 wherein said solid cylinder comprises pliable, flexible material.

13. A rebar saddle for securing and suspending in space reinforcing bars used in strengthening concrete comprising:

an elongated solid cylinder having a first and second end, sides, and a longitudinal axis;

said elongated solid cylinder first end defining a saddle formed therein adapted to receive and secure the reinforcing bar; and said elongated solid cylinder second end defining a blind hole formed therein adapted to receive a rod connected to an associated object whereby the rebar saddle suspends the reinforcing bar in position to have concrete poured around it and cured.

14. The rebar saddle as defined in claim 13 further including a pair of nail openings penetrating the cylinder sides to the second end, the nail openings adapted to receive nails to nail the rebar saddle to an associated object.

15. The rebar saddle as defined in claim 13 wherein said blind hole includes threads formed therein, said threads adapted to receive an associated threaded bolt attached to an associated object in order to secure said rebar saddle to said associated object.

16. In combination, a rebar saddle and stake adapted to receive and suspend reinforcing bars above ground comprising:

an elongated solid cylinder having a first and second end, sides, and longitudinal axis;

said elongated solid cylinder first end defining a saddle formed therein adapted to receive and secure the reinforcing bar;

said elongated solid cylinder second end defining a blind hole formed therein, said blind hole having a longitudinal axis parallel to the solid cylinder longitudinal axis; and a stake having two ends, one end of which adapted to be driven into the ground and the other end adapted to be received by said blind hole formed in said solid cylinder second end whereby the stake may be driven into the ground, the cylinder placed upon said stake, and said saddle formed in said cylinder first end securing and suspending reinforcing bars above ground in order that concrete may be poured around the bars and cured.

17. The combination as defined in claim 16 wherein said solid cylinder comprises non-rusting material and said stake comprises rustable material whereby rust, rusting the stake, is stopped by the solid cylinder and can not reach the associated reinforcing bar held in the saddle formed in the solid cylinder.

* * * * *